US005341977A

United States Patent [19]

Nishimura

[11] Patent Number: 5,341,977

[45] Date of Patent: Aug. 30, 1994

[54] YARN DRAWING-IN NOZZLE

[75] Inventor: Yoshihide Nishimura, Ehime, Japan

[73] Assignee: Teijin Seiki Company Limited, Osaka, Japan

[21] Appl. No.: 14,557

[22] Filed: Feb. 8, 1993

Related U.S. Application Data

[63] Continuation of Ser. No. 639,736, Jan. 10, 1991, abandoned, which is a continuation of Ser. No. 340,039, Apr. 18, 1989, abandoned.

[30] Foreign Application Priority Data

Aug. 17, 1988 [JP] Japan ..... 63-205061

[51] Int. Cl.[5] ..... D01H 5/28

[52] U.S. Cl. ..... 226/97; 28/272; 57/279; 139/435.5; 226/7; 226/91; 226/92

[58] Field of Search ..... 226/7, 91, 92, 97; 28/272, 203, 204; 57/279, 280; 139/435.1, 435.2, 435.3, 435.4, 435.5

[56] References Cited

U.S. PATENT DOCUMENTS

| | | | |
|---|---|---|---|
| 2,199,700 | 1/1960 | Russell | 226/97 X |
| 2,995,801 | 8/1961 | Cormier et al. | 28/272 |
| 3,367,373 | 2/1968 | Fransen | 139/435 |
| 3,379,002 | 4/1968 | Rosenstein | 28/272 X |
| 3,474,615 | 10/1969 | Irwin et al. | 28/272 X |
| 3,730,713 | 5/1973 | McDermott et al. | 28/272 |
| 4,418,789 | 12/1983 | Eckert | 226/97 X |
| 4,458,730 | 7/1984 | Dondi Benelli | 139/435 X |
| 4,625,770 | 12/1986 | Ishikawa | 139/435 X |
| 4,682,636 | 4/1987 | Derichs | 139/435 |

*Primary Examiner*—Daniel P. Stodola
*Assistant Examiner*—William Stryjewski
*Attorney, Agent, or Firm*—Lane, Aitken & McCann

[57] ABSTRACT

A yarn drawing-in nozzle for drawing a yarn through an eye of a drawn-through member, comprising: a compression nozzle provided in an upstream side of the drawn-through member and having a block, the block being formed with a guide passage to which compressed air is supplied and into which the yarn with its distal end portion is inserted and through which the yarn is drawn through the eye of the drawn-through member with the aid of the compressed air; the guide passage of the compression nozzle being defined by an axially elongated groove having an upper open end and a bottom surface along a yarn drawing-in direction so that the compressed air is supplied through the bottom surface to the guide passage and that the distal end portion is drawn toward the bottom surface through the upper open end and that the yarn is drawn through the eye of the drawn-through member from a distal end of the yarn along the bottom surface.

18 Claims, 3 Drawing Sheets

YARN DRAWING-IN NOZZLE

CROSS-REFERENCE TO RELATED APPLICATION

This is a continuation of Ser. No. 07/639,736, filed on Jan. 10, 1991, now abandoned, which is a continuation of Ser. No. 07/340,039, filed on Apr. 18, 1989, now abandoned.

FIELD OF THE INVENTION

The present invention relates in general to yarn drawing-in nozzles, and in particular to a yarn drawing-in nozzle used in a yarn drawing-in apparatus wherein a yarn or thread is drawn through an eye of a drawn-through member with the aid of compressed air.

A yarn drawing-in apparatus, wherein a yarn or thread is drawn through a drawn-through member, is normally employed in the fields dealing with filament materials such as yarns, threads or the like. The present inventor developed an automatic warp drawing-in apparatus used in weaving machine factories. In such a warp drawing-in apparatus, there are provided yarn drawing-in nozzles comprising compression nozzles each divided into upper and lower blocks, and a yarn is drawn automatically through an eye of a drawn-through member such a heddle or dropper which is positioned between the compression nozzles, with the aid of the flow of compressed air supplied to the compression nozzles.

Such yarn drawing-in nozzles are disclosed in Japanese patent application No. 62-153002 that has already been filed by the present applicant, and shown in FIGS. 6 through 8. In FIGS. 6 through 8, a compression nozzle is generally designated by reference numeral 1 and includes an upper block 2 and a lower block 3. The upper block 2 is formed with a guide passage 4 having a square cross section which gradually contracts in a yarn drawing-in direction indicated by the arrow y in FIG. 6. The upper portion of the upper block 2 is connected through a pin 5 to an arm 6*a* of an opening and closing mechanism 6. The lower block 3 is formed at the upstream side of the yarn drawing-in direction y with a main compressed air injecting bore 7 and at the downstream side with an auxiliary compressed air injecting bore 8. The compressed air injecting bores 7 and 8 are connected with a source of compressed air (not shown), the compressed air being injected to the guide passage 4 through the main compressed air injecting bore 7 and toward an eye 9*a* of a drawn-through member 9 positioned downstream of the compression nozzle 1 through the auxiliary compressed air injecting bore 8.

A yarn 10 is one which is drawn through the eye 9*a* of the drawn-through member 9 by the compression nozzle 1, and the yarn 10 with its distal end 10*a* raised upward is supplied to the upstream side of the compression nozzle 1 by means of a yarn supplying apparatus (not shown). The supplied yarn 10 is inserted into a passage inlet 4*a* of the guide passage 4, while its distal end portion 10*b* is curved as shown in FIG. 6 by the compressed air injected from a yarn insertion nozzle 11. The yarn 10 is then drawn in the guide passage 4 with the aid of the flow of the compressed air injected from the main compressed air injecting bore 7 to the guide passage 4. The distal end 10*a* of the yarn 10 is further drawn through the eye 9*a* of the drawn-through member 9 with the aid of the flow of the compressed air injected from the compressed air injecting bores 7 and 8. A second compression nozzle 12, which is substantially identical to the compression nozzle 1, is provided downstream of the drawn-through member 9 so that the yarn drawn through the eye 9*a* of the drawn-through member 9 by the compression nozzle 1 is further drawn through the second nozzle 12. It is noted that, in the case that a plurality of drawn-through members are provided, the yarn 10 can be drawn successively through the drawn-through members by providing along the yarn drawing-in direction y a plurality of compression nozzles substantially identical to the compression nozzle 1 and corresponding in number to the drawn-through members.

After the yarn drawing-in operation is completed, the opening and closing mechanism 6 is operated and the arm 6*a* is rotated upward in the clockwise direction by the rotational shaft 6*b*, as shown in FIG. 8. Consequently, the upper block 2 is moved away from the lower block 3. At the same time, the drawn-through member 9 that has been positioned moves in a direction perpendicular to the yarn drawing-in direction y, and the yarn drawn through the drawn-through member 9 is removed from the upper and lower blocks 2 and 3 moved away from each other, together with the drawn-through member 9. For the next yarn drawing-in operation, the opening and closing mechanism 6 is again operated and the arm 6*a* is rotated downward in the opposite direction until a lower mating surface 2*a* of the upper block 2 is brought into engagement with an upper mating surface 3*a* of the lower block 3 to form again the guide passage 4. The mating surfaces 2*a* and 3*a* are required to be tightly engaged with each other in order that the guide passage 4 is tightly closed and that the flow of the compressed air for drawing in the yarn is formed without disturbance and that the yarn 10 is smoothly passed through the guide passage 4 with the aid of the flow of the compressed air. For this reason, as shown in FIG. 6, between the arm 6*a* and the upper block 2 there are provided compression springs 13 and 14 so that, when the upper mating surface 2*a* of the upper block 2 is brought into engagement with the lower mating surface 3*a* of the lower block 3, the upper block 2 is forced against the lower block 3 and the mating surfaces 2*a* and 3*a* are tightly engaged with each other.

As previously described, the compression nozzle 1 includes the upper and lower blocks 2 and 3, and the upper and lower blocks 2 and 3 are moved toward and away from each other by the opening and closing mechanism 6, each time the drawn-through member is removed together with the yarn 10. For this reason, there was the drawback that yarn drawing-in failure tends to occur and the apparatus becomes expensive to eliminate the yarn drawing-in failure.

That is, in FIG. 6, in the case that the yarn 10 is inserted into the passage inlet 4*a* of the guide passage 4, the yarn 10 is formed with the curved portion 10*b* due to the compressed air injected from the yarn insertion nozzle 11 and contacts with the end portions of the mating surfaces 2*a* and 3*a* of the passage inlet 4. Further, since the yarn 10 itself has sometimes been defibered or since sometimes defibering of the yarn will occur due to the compressed air injected from the yarn insertion nozzle 11, a single yarn of the defibered yarn 10 was sometimes hooked between the mating surface 2*a* and the mating surface 3*a* and cut, thereby incurring yarn drawing-in failure. In addition, since the yarn 10 is inserted into the passage inlet 4*a* after the curved portion 10*b* is once formed, contact resistance will occur between the curved portion 10*b* and the passage inlet 4*a* and sometimes the yarn 10 is hooked on the passage inlet 4*a*. For this reason, sometimes the yarn 10 is not inserted into the guide passage 4 and thus the yarn drawing-in failure was incurred. This tendency is remarkable in a yarn having stiffness, and therefore in the case of a yarn having stiffness, it could not be avoided that the yarn drawing-in failure occurs very frequently.

In order to overcome the yarn drawing-in failure described above, the working accuracy of the mating surface 2*a* of the upper block 2 and the mating surface 3*a* of the lower block 3 has been enhanced to make very small an interstice between the mating surfaces 2*a* and 3*a*. However, there occurs the drawback that the apparatus itself becomes expensive, since the working cost is increased. Furthermore, even if the accuracy of the mating surfaces 2*a* and 3*a* were enhanced, the aforesaid yarn drawing-in failure could not be overcome completely in the case of a very fine yarn, since an interstice is still formed between the upper and lower blocks 2 and 3.

Accordingly, it is an object of the present invention to provide an improved yarn drawing-in nozzle which can prevent the yarn drawing-in failure and which is structurally simpler and less expensive than the earlier yarn drawing-in nozzle.

SUMMARY OF THE INVENTION

In accordance with one important aspect of the present invention, there is provided a yarn drawing-in nozzle for drawing a yarn through an eye of a drawn-through member, comprising: a compression nozzle provided in an upstream side of the drawn-through member and having a block, the block being formed with a guide passage to which compressed air is supplied and into which the yarn with its distal end portion is inserted and through which the yarn is drawn through the eye of the drawn-through member with the aid of the compressed air; the guide passage of the compression nozzle being defined by an axially elongated groove having an upper open end and a bottom surface along a yarn drawing-in direction so that the compressed air is supplied through the bottom surface to the guide passage and that the distal end portion is drawn toward the bottom surface through the upper open end and that the yarn is drawn through the eye of said drawn-through member from a distal end of the yarn along the bottom surface.

In accordance with another important aspect of the present invention, there is provided a yarn drawing-in nozzle for drawing a yarn through an eye of a first drawn-through member and through eyes of a plurality of second drawn-through members, the first and second drawn-through members being spaced apart from one another in a yarn drawing-in direction, comprising: a first compression nozzle provided in an upstream side of the first drawn-through member and having a block, the block being formed with a guide passage to which compressed air is supplied and into which the yarn with its distal end portion is inserted and through which the yarn is drawn through the eye of the first drawn-through member with the aid of the compressed air; the guide passage of the first compression nozzle being defined by an axially elongated groove having an upper open end and a bottom surface along the yarn drawing-in direction so that the compressed air is supplied through the bottom surface to the guide passage and that the distal end portion is drawn toward the bottom surface through the upper open end and that the yarn is drawn through the eye of the first drawn-through member from a distal end of the yarn along the bottom surface; and a plurality of second compression nozzles provided between the first drawn-through member and the plurality of second drawn-through members and respectively having blocks formed with guide passages to which compressed air is supplied and through which the yarn drawn through the eye of the first drawn-through member is drawn through the eyes of the second drawn-through members with the aid of the compressed air; each of the guide passages of the second compression nozzles being defined by an axially elongated groove having an upper open end and a bottom surface along the yarn drawing-in direction so that the compressed air is supplied from the bottom surface.

In accordance with another important aspect of the present invention, there is provided a yarn drawing-in nozzle for drawing a yarn through an eye of a first drawn-through member and through eyes of a plurality of second drawn-through members, the first and second drawn-through members being spaced apart from one another in a yarn drawing-in direction, comprising: a first compression nozzle provided in an upstream side of the first drawn-through member and having a block, the block being formed with a guide passage to which compressed air is supplied and into which the yarn with its distal end portion is inserted and through which the yarn is drawn through the eye of the first drawn-through member with the aid of the compressed air; the guide passage of the first compression nozzle being defined by an axially elongated groove having an upper open end and a bottom surface along the yarn drawing-in direction so that the compressed air is supplied through the bottom surface to the guide passage and that the distal end portion is drawn toward the bottom surface through the upper open end and that the yarn is drawn through the eye of the first drawn-through member from a distal end of the yarn along the bottom surface; and a plurality of second compression nozzles provided between the first drawn-through member and the plurality of second drawn-through members and respectively having blocks formed with guide passages to which compressed air is supplied and through which the yarn drawn through the eye of the first drawn-through member is drawn through the eyes of the second drawn-through members with the aid of the compressed air.

In the present invention, even if a yarn curved and supplied to the first compression nozzle is stiffness or very fine, the yarn can be smoothly drawn through the drawn-through member without being hooked on the guide passage and contact resistance to the guide passage. Even in the case that a plurality of second compression nozzles are provided in the downstream side of the first compression nozzle to draw in the yarn, the yarn can be smoothly drawn in without being hooked on the guide passage, since each of the second compression nozzles is substantially identical to the first compression nozzle. Consequently, yarn drawing-in failure is overcome, and the apparatus according to the present invention becomes inexpensive since it is structurally simple.

BRIEF DESCRIPTION OF THE DRAWINGS

The features and advantages of a yarn drawing-in nozzle according to the present invention will be more clearly understood from the following description taken in conjunction with the accompanying drawings.

DESCRIPTION OF THE PREFERRED EMBODIMENTS

Referring now in greater detail to the drawings and initially to FIGS. 1 through 4, there is shown a yarn drawing-in nozzle 40 constructed in accordance with a first embodiment of the present invention.

Figure 1:
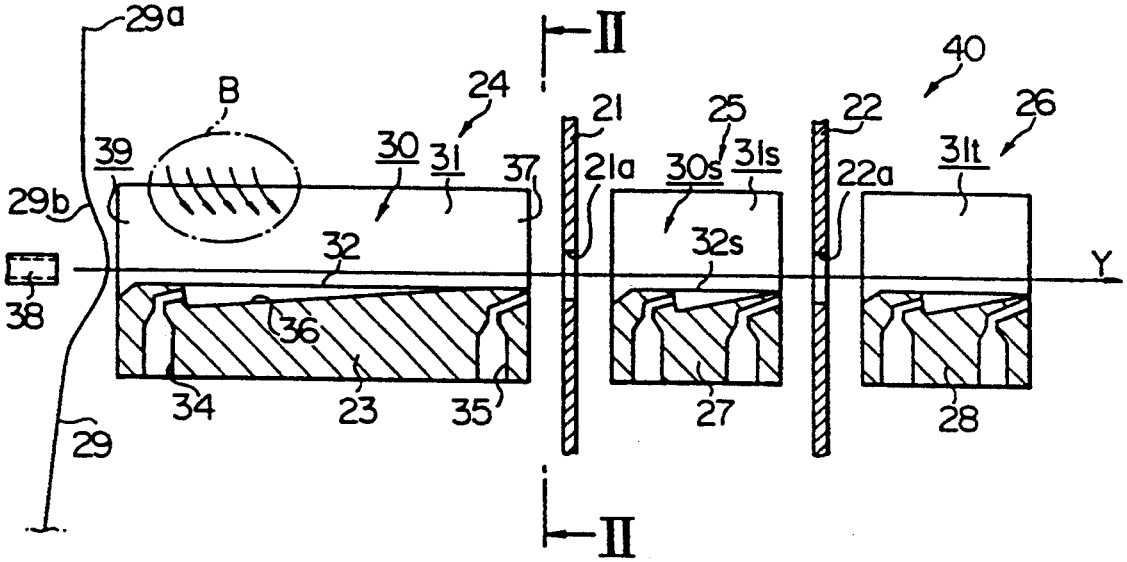
FIG. 1 is a longitudinal sectional view showing a first embodiment of the yarn drawing-in nozzle according to the present invention.

In FIG. 1, reference numerals 21 and 22 designate a first drawn-through member and a second drawn-through member, respectively, which are disposed from an upstream side to a downstream side of a yarn drawing-in direction Y. Although, in this embodiment, the second drawn-through member 22 comprises a single member, it may also be replaced with a plurality of drawn-through members. The first drawn-through member 21 is formed with an eye 21*a* through which a yarn or thread 29 is drawn in the yarn drawing-in direction Y, and the second drawn-through member 22 is also formed with an eye 22*a* through which the yarn 29 is drawn in the yarn drawing-in direction Y. A first compression nozzle 24 having a first block 23 in one piece is provided in the upstream side of the first drawn-through member 21, while a second compression nozzle 25 is provided between the first and second drawn-through members 21 and 22. Further, a third compression nozzle 26 is provided in the downstream side of the second drawn-through member 22. In this embodiment, a plurality of compression nozzles, disposed successively between the first drawn-through member 21 and a plurality of the second drawn-through members, comprise the second compression nozzle 25 and the third compression nozzle 26, and the second and third compression nozzles 25 and 26 have a second block 27 in one piece and a third block 28 in one piece, respectively, which are substantially the same as the first block 23 of the first compression nozzle 24.

Figure 2:
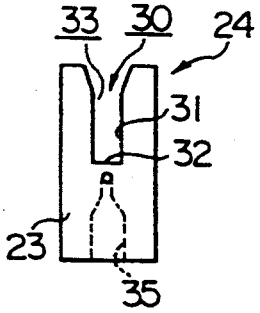
FIG. 2 is an elevational view taken substantially along the line II—II of FIG. 1.

The first block 23 of the first compression nozzle 24 is formed at its upper half portion with a first guide passage 30 to which compressed air is supplied and through which the yarn 29 to be inserted from the upstream side of the first compression nozzle 24 is guided by the compression air to draw the yarn 29 through the eye 21*a* of the first drawn-through member 21. As shown in FIG. 2, the first guide passage 30 is defined by an upwardly open, elongated groove 31, the elongated groove 31 having a width narrow along the yarn drawing-in direction Y and an axially elongated bottom surface 32. An upper open end 33 of the elongated groove 31 defining the guide passage 30 also have a narrow width and is axially elongated along the yarn drawing-in direction Y.

The first block 23 of the first compression nozzle 24 is further formed at its upstream side with an inlet injection bore 34 and at its downstream side with an outlet injection bore 35. The inlet injection bore 34 is at its lower end connected to a source of compressed air (not shown), and is curved at its upper end in the yarn drawing-in direction Y and opens through a recess 36 to the bottom surface 32 of the elongated groove 31. The outlet injection bore 35 is also at its lower end connected to the compressed air source (not shown) and curved at its upper end and opens toward the central portion of the eye 21*a* of the first drawn-through member 21. The recess 36 formed at the upper end of the inlet injection bore 34 is slowly inclined upward from the upper end of the inlet injection bore 34 in the yarn drawing-in direction Y and terminates in a passage outlet 37 of the bottom surface 32. If the compressed air is introduced into the inlet and outlet injection bores 34 and 35 from the aforesaid compressed air source, the compressed air introduced into the inlet injection bore 34 will be supplied through the recess 36 to the bottom surface 32 and form a flow of the yarn drawing-in direction Y, while the compressed air introduced into the outlet injection bore 35 will form a flow directed toward the central portion of the eye 21*a* of the first drawn-through member 21.

Figure 3:
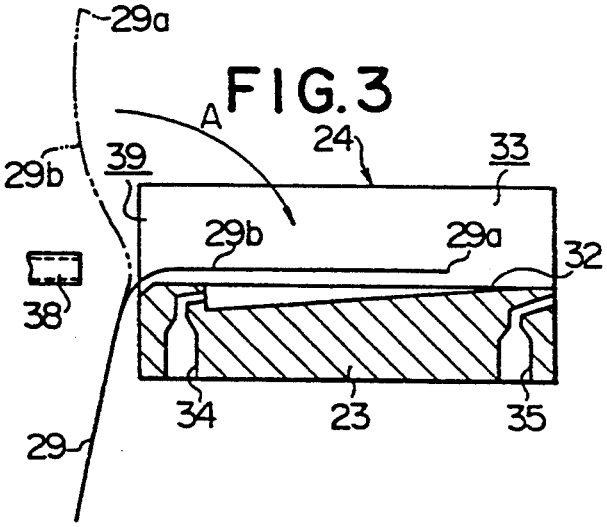
FIG. 3 is a longitudinal sectional view showing how a distal end portion of a yarn is draw in the nozzle through an upper open end of the nozzle.

A yarn insertion nozzle 38 is provided in the upstream side of the first compression nozzle 24 and connected to the aforesaid compressed air source so that the compressed air is injected along the yarn drawing-in direction Y toward a passage inlet 39 of the guide passage 30. If the yarn 29 with its distal end 29*a* raised upward is supplied to the upstream side of the first compression nozzle 24 by a supply mechanism (not shown), the yarn 29 is curved at the distal end portion 29*b* thereof toward the yarn drawing-in direction Y by the compressed air injected from the yarn insertion nozzle 38 and is inserted into the passage inlet 39 of the guide passage 30. The curved distal end portion 29*b* of the yarn 29 is further drawn in by the flow of the compressed air supplied from the inlet injection bore 34. As shown in FIG. 3, the distal end portion 29*b* is drawn toward a direction A from a position indicated by the broken lines to a position indicated by the solid line through the open end 33 of the elongated groove 31, and then the distal end 29*a* is drawn near the bottom surface 32. It is noted that, as shown by an encircled portion B in FIG. 1, in the vicinity of the passage inlet 39 of the open end 33, there is formed, by the flow of the compressed air supplied from the inlet injection bore 34, the flow from the outside toward the elongated groove 31 which causes the distal end portion 29*b* of the yarn 29 to be drawn within the elongated groove 31. Next, the distal end 29*a* drawn near the bottom surface 32 is drawn through the eye 21*a* of the first drawn-through member 21 by the flow of the compressed air supplied from the inlet and outlet injection bores 34 and 35. It is noted that the second block 27 of the second compression nozzle 25 and the third block 28 of the third compression nozzle 26 are substantially identical in construction and function to the first block 23 of the first compression nozzle 24 and that an axially elongated groove 31*s* of the second block 27 and an axially elongated groove 31*t* of the third block 28 are also substantially identical to the axially elongated groove 31 of the first block 23. The detailed description of the second and third blocks 27 and 28 will therefore be omitted.

Figure 4:
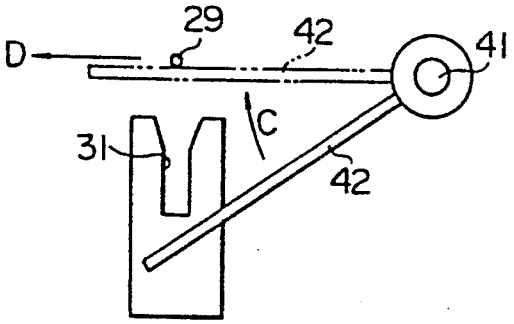
FIG. 4 is a front view showing how the yarn drawn through an eye of a drawn-through member is removed from the nozzle.

The yarn 29 drawn through the eye 21*a* of the first drawn-through member 21 by the first compression nozzle 24 is then drawn through the eye 22*a* of the second drawn-through member 22 by the second and third compression nozzles 25 and 26 in the same manner as the first compression nozzle 24. Finally, as shown in FIG. 4, the yarn 29 is raised upward from the elongated groove of each compression nozzle by rotating upward in a direction C a yarn removing bar 42 mounted on a rotational shaft 41 which is driven to rotate about its own axis by a drive mechanism (not shown), and is removed in a direction D by an external mechanism, together with the first and second drawn-through members 21 and 22.

The operation of the yarn drawing-in nozzle constructed as described above will hereinafter be described in detail.

If, in FIGS. 1 and 2, the distal end portion 29*b* of the yarn 29 with the distal end 29*a* raised upward is supplied to the upstream side of the first compression nozzle 24 by the supply mechanism (not shown), the compressed air is then injected from the yarn insertion nozzle 38 and the distal end portion 29*b* is curved in the yarn drawing-in direction Y by the compressed air and inserted into the passage inlet 39 of the guide passage 30. At this time, the compressed air supplied to the inlet and outlet injection bores 34 and 35 of the first compression nozzle 24 has formed a flow of the yarn drawing-in direction Y along the bottom surface 32 of the elongated groove 31, and therefore the distal end portion 29*b* is drawn in the elongated groove 31 by the flow of air directed from the outside toward the elongated groove 31 that has been developed in the vicinity of the passage inlet 39 of the open end 33, as shown in the encircled portion B of FIG. 1. As shown in FIG. 3, the distal end portion 29*b* is drawn in the direction A and the distal end 29*a* thereof is drawn toward the bottom surface 32. That is, the distal end portion 29*b* is once curved in the opposite direction by the compressed air of the yarn insertion nozzle 38, and then the distal end 29*a* is drawn near the bottom surface 32 by the flow of air directed from the outside toward the elongated groove 31. For this reason, even if the yarn 29 has stiffness, it can be inserted into the guide passage 30 without contact resistance to the guide passage 30. In addition, since the block 23 comprises a block of one piece and thus has no joint portions, a single yarn of the defibered yarn 29 is never hooked on the block 23. The block 23 in one piece is effective particularly to a very fine yarn. It is noted that, as shown in FIGS. 1 and 2, the corners of the passage inlet 39 and the open end 33 of the block 23 are chamfered not so as to hook a single yarn thereon.

The distal end 29*a* of the yarn 29 drawn toward the bottom surface 23 is then drawn through the eye 21*a* of the first drawn-through member 21 by the flow of the compressed air supplied from the inlet and outlet injection nozzles 34 and 35. The yarn 29 is further drawn through the eye 22*a* of the second drawn-through member 22 by the second and third compression nozzles 25 and 26. Since each of the second block 27 of the second compression nozzle 25 and the third block 28 of the third compression nozzle 26 also comprises a block of one piece and has no joint portions, the yarn 29 can be smoothly drawn through the eye 22*a* without being hooked on the blocks. Thereafter, the rotational shaft 41 is driven by the drive mechanism (not shown), and the yarn removing bar 42 is rotated upward in the direction C. Consequently, the yarn 29 is raised upward from the elongated groove of each compression nozzle, and removed in the direction D by the external mechanism (not shown), together with the first and second drawn-through members 21 and 22.

As previously described, in the first embodiment shown in FIGS. 1 through 4, the guide passage 30 of the first nozzle 24 is constituted by the upwardly open, elongated groove 31, and the compressed air is supplied from the bottom surface 32 of the elongated groove 31 through the inlet injection bore 34. For this reason, the yarn 29 curved and supplied to the first compression nozzle 24 by the yarn insertion nozzle 38 can be smoothly drawn through without being hooked on the guide passage 30 and contact resistance to the guide passage 30, even if the yarn is stiffness or very fine. In addition, even in the case that a plurality of compression nozzles (in this embodiment, the second and third compression nozzles 25, 26) are provided in the downstream side of the first compression nozzle 24 to draw a yarn therethrough, the yarn can also be drawn through smoothly, since the second and third compression nozzles 25 and 26 are substantially identical to the first compression nozzle 24. As a result, the aforementioned yarn drawing-in failure can be overcome by the yarn drawing-in nozzle according to the present invention which is structurally simpler and less expensive than the earlier yarn drawing-in nozzle.

Figure 5:
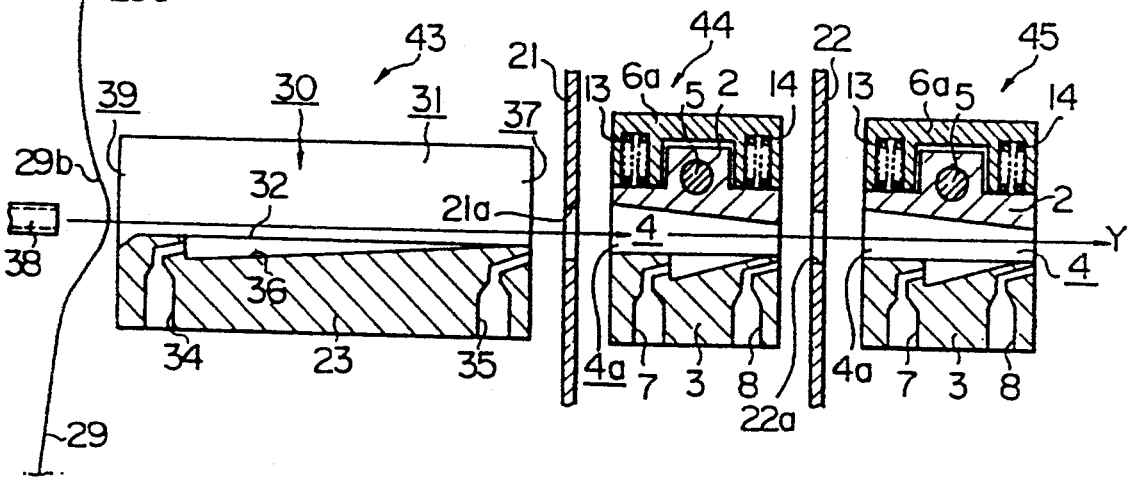
FIG. 5 is a longitudinal sectional view showing a second embodiment of the yarn drawing-in nozzle according to the present invention.

Referring to FIG. 5, there is shown a second embodiment of the yarn drawing-in nozzle in accordance with the present invention. The members or portions substantially identical to those of the first embodiment shown in FIGS. 1 through 4 are designated by like reference numerals for avoiding the detailed description.

Figure 6:
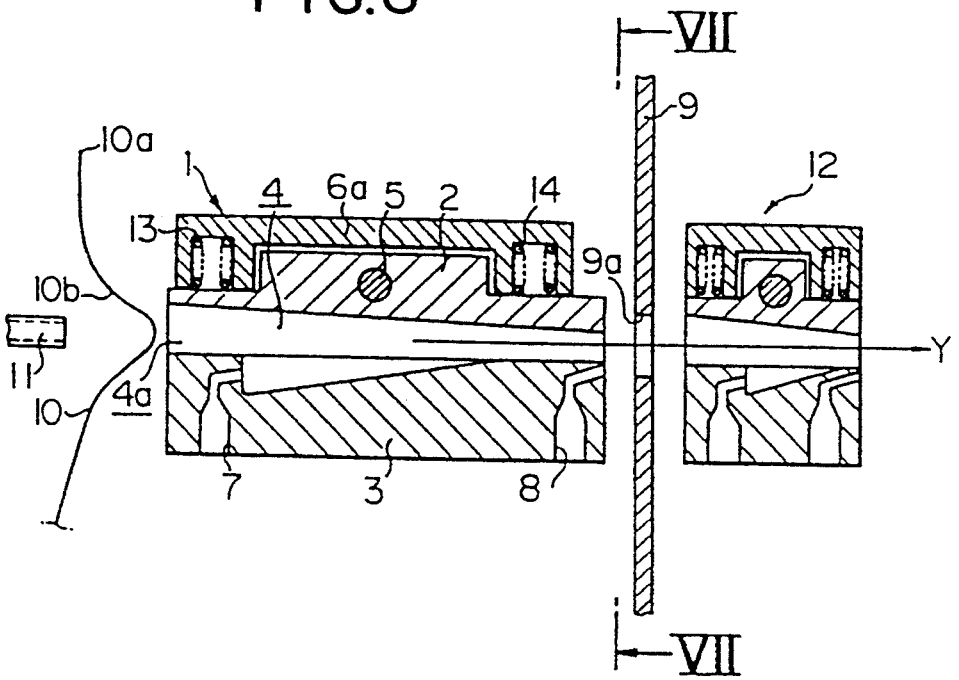
FIG. 6 is a longitudinal sectional view showing an earlier yarn drawing-in nozzle by the present inventor.
Figure 7:
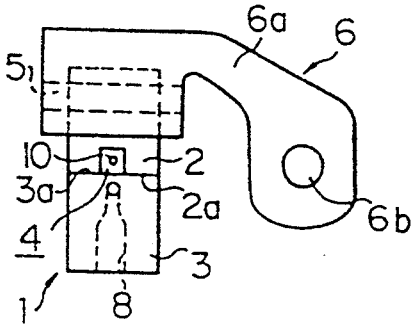
FIG. 7 is an elevational view taken substantially along the line VII—VII of FIG. 6.
Figure 8:
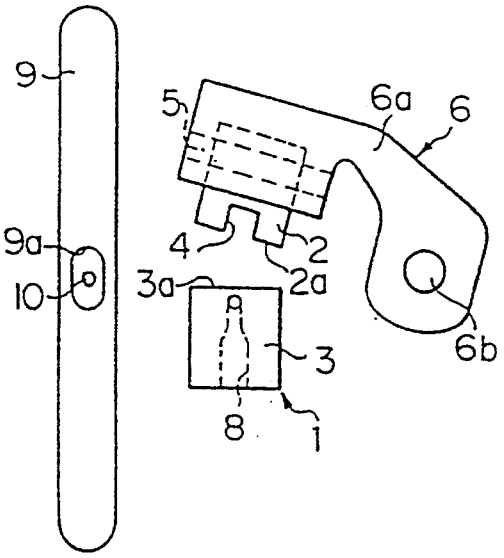
FIG. 8 is a front view of the nozzle and the drawn-through member of FIG. 6, the upper portion of the nozzle being moved away from the lower portion to remove therefrom a yarn drawn through an eye of the drawn-through member.

In FIG. 5, reference numeral 43 designates a first compression nozzle 43 provided in the upstream side of a first drawn-through member 21, and reference numerals 44 and 45 designate a second compression nozzle and a third compression nozzle, respectively. The second and third compression nozzles 44 and 45 constitute a plurality of compression nozzles which are successively disposed between the first drawn-through member 21 and a plurality of second drawn-through members. In this embodiment, the plurality of second drawn-through members are replaced with a single drawn-through member 22. The first compression nozzle 43 is substantially identical in construction and function to the first compression nozzle 24 shown in FIGS. 1 and 2. Therefore, the same operation and effect as the first embodiment shown in FIGS. 1 through 4 can also be obtained by the second embodiment of FIG. 5. Since the second and third compression nozzles 44 and 45 are substantially identical in construction and function to the compression nozzle 1 shown in FIGS. 6 and 7, they are designated by like reference numerals to avoid the description. Further, in the case that a plurality of second compression nozzles are provided in the downstream of the first compression nozzle 43 to draw a yarn therethrough, the compression nozzle shown in FIG. 6 can be used as a second nozzle, since the first compression nozzle 43 according to the present invention is provided in the upstream side of the yarn drawing-in direction Y to prevent the distal end portion of the yarn, which is curved at the inlet of the compression nozzle, from being hooked on the block of the compression nozzle. Accordingly, the yarn drawing-in failure can also be overcome by the second embodiment which is structurally simple and inexpensive.

As will be understood from the first embodiment, even if a yarn curved and supplied to the first compression nozzle is stiffness or very fine, the yarn can be smoothly inserted and drawn without being hooked on the guide passage or contact resistance to the guide passage, since the guide passage of the first compression nozzle is defined by the upwardly open, elongated groove and since the compression air is supplied from the bottom surface of the elongated groove. In addition, even in the case that a plurality of second compression nozzles are provided in the downstream side of the first compression nozzle to draw in the yarn, the yarn can be smoothly drawn in without being hooked on the guide passage, since each of the second compression nozzles is substantially identical to the first compression nozzle. Consequently, yarn drawing-in failure is overcome, and the apparatus according to the present invention becomes inexpensive since it is structurally simple.

While the yarn insertion nozzle 38 has been provided in the first and second embodiments, it is noted that the provision of the nozzle 38 is not always necessary in the case of normal yarns.

As will be understood from the second embodiment, even if a yarn curved and supplied to the first compression nozzle is stiffness or very fine, the yarn can be smoothly inserted and drawn without being hooked on the guide passage or contact resistance to the guide passage, since the guide passage of the first compression nozzle is defined by the upwardly open, elongated groove and since the compression air is supplied from the bottom surface of the elongated groove. Furthermore, in the case that a plurality of second compression nozzles are provided in the downstream of the first compression nozzle to draw a yarn therethrough, the compression nozzle shown in FIG. 6 can be used as a second nozzle, since the first compression nozzle according to the present invention is provided in the upstream side of the yarn drawing-in direction Y to prevent the distal end portion of the yarn, which is curved at the inlet of the compression nozzle, from being hooked on the block of the compression nozzle. Accordingly, the yarn drawing-in failure can also be overcome by the second embodiment which is structurally simple and inexpensive.

The invention has been described with reference to the preferred embodiments. Obviously modifications and alternations will occur to others upon a reading and understanding of this application. It is intended to include all such modifications and alternations insofar as they come within the scope of the appended claims or the equivalents thereof.

I claim:

1. A yarn drawing-in nozzle for drawing a yarn through an eye of a drawn-through member, comprising:

an insertion nozzle provided on an upstream side of said drawn-through member and injecting first compressed air along a yarn-drawing direction; and a compression nozzle provided between said insertion nozzle and said drawn-through member and having a block, the block being formed with a guide passage to which said first compressed air is injected and into which said yarn with its distal end is inserted and through which said yarn is drawn through said eye with the aid of said first compressed air injected along said yarn-drawing direction, the block being further formed with an injection nozzle open into said guide passage at a predetermined angle with respect to said yarn-drawing direction for injecting second compressed air to said guide passage at said predetermined angle to provide a forwarding action on said yarn in said guide passage.

2. A yarn drawing-in nozzle for drawing a yarn through an eye of a first drawn-through member, comprising:

a first compression nozzle provided in an upstream side of said drawn-through member and having a block, the block being formed with a guide passage to which compressed air is injected along a yarn-drawing direction and into which said yarn with its distal end is inserted and through which said yarn is drawn through said eye with the aid of said compressed air injected along said yarn-drawing direction, the block being further formed with an injection nozzle open into said guide passage for injecting compressed air to said guide passage to provide a forwarding action on said yarn in said guide passage;

said guide passage of said compression nozzle being defined by an axially elongated groove having an upper open end and a bottom surface along said yarn-drawing direction so that the distal end of said yarn is drawn toward said bottom surface through said upper open end.

3. A yarn drawing-in nozzle as set fourth in claim 2, which further comprises:

a plurality of second drawn-through members each having an eye through which said yarn is drawn, said first drawn-through member and said second drawn-through members being spaced apart from one another in said yarn drawing-in direction; and a plurality of second compression nozzles provided between said first drawn-through member and said second drawn-through members and respectively having second blocks, each second block being formed with a guide passage to which compressed air is supplied and through which said yarn is drawn.

4. A method of drawing a yarn through an eye of a drawn-through member through a compression nozzle formed with an axially elongated guide passage having an upper open end and a bottom surface, comprising the steps of:

positioning a yarn in the vicinity of said compression nozzle:

injecting compressed air to said compression nozzle so that a distal end of said yarn is drawn toward said bottom surface through said upper open end and then drawn through said eye of said drawn-through member.

5. A method as set forth in claim 4, wherein said compression nozzle is further formed with an injection nozzle open into said guide passage, further comprising the step of injecting compressed air to said guide passage through the injection nozzle to provide a forwarding action on said yarn in said guide passage.

6. A yarn drawing-in nozzle for drawing a yarn through an eye of a drawn-through member, comprising:

a compression nozzle provided in an upstream side of said drawn-through member and having a block, the block having an inlet end face and an outlet end face and being formed with a guide passage extending therethrough, the block being formed further with a first bore open into said guide passage for supplying compressed air to said guide passage to provide a forwarding action on said yarn in said guide passage, and a second bore open to said outlet end face of said block at a lower position than said guide passage for supplying compressed air to further provide a forwarding action on the yarn between said block and first drawn-through member;

said guide passage of said compression nozzle being defined by an axially elongated groove having an upper open end and a bottom surface along a yarn drawing-in direction so that a distal end portion of said yarn is drawn toward said bottom surface through said upper open end.

7. A yarn drawing-in nozzle as set forth in claim 6, wherein said block of said compression nozzle comprises a block of one piece.

8. A yarn drawing-in nozzle according to claim 6, wherein the upper open end of the groove has a width at least as great as the width of the groove at any other level between the bottom surface and the upper open end of the groove.

9. A yarn drawing-in nozzle for drawing a yarn through an eye of a first drawn-through member and through eyes of a plurality of second drawn-through members, the first and second drawn-through members being spaced apart from one another in a yarn drawing-in direction, comprising:

a first compression nozzle provided in an upstream side of said first drawn-through member and having a block, the block having an inlet end face and an outlet end face and being formed with a guide passage extending therethrough, the block being further formed with a first bore open into said guide passage for supplying compressed air to said guide passage to provide a forwarding action on said yarn in said guide passage, and a second bore open to said outlet end face of said block at a lower position than said guide passage for supplying compressed air to further provide a forwarding action on the yarn that has been passed through said second guide passage;

said guide passage of said first compression nozzle being defined by an axially elongated groove having an upper open end and a bottom surface along a yarn drawing-in direction so that a distal end portion of said yarn is drawn toward said bottom surface through said upper open end; and a plurality of second compression nozzles provided between said first drawn-through member and said plurality of second drawn-through members and respectively having second blocks, each second block having an inlet end face and an outlet end face and formed with a second guide passage extending therethrough, each second block being further formed with a first bore open into said second guide passage for supplying compressed air to said second guide passage to provide a forwarding action on said yarn in said second guide passage, and a second bore open to said outlet end face of said second block at a lower position than said second guide passage for supplying compressed air to further provide a forwarding action on the yarn that has been passed through said second guide passage;

each of said guide passages of said second compression nozzles being defined by an axially elongated groove having an upper open end and a bottom surface along said yarn drawing-in direction.

10. A yarn drawing-in nozzle as set forth in claim 9, wherein said block of said first compression nozzle comprises a block of one piece and each of said blocks of said second compression nozzles comprises a block of one piece.

11. A yarn drawing-in nozzle according to claim 9, wherein the upper open end of the groove has a width at least as great as the width of the groove at any other level between the bottom surface and the upper open end of the groove.

12. A yarn drawing-in nozzle for drawing a yarn through an eye of a first drawn-through member and through eyes of a plurality of second drawn-through members, the first and second drawn-through members being spaced apart from one another in a yarn drawing-in direction, comprising:

a first compression nozzle provided in an upstream side of said first drawn-through member and having a block, the block having an inlet end face and an outlet end face and being formed with a guide passage extending therethrough, the block being further formed with a first bore open into said guide passage for supplying compressed air to said guide passage to provide a forwarding action on said yearn in said guide passage, and a second bore open to said outlet end face of said block at a lower position than said guide passage for supplying compressed air to further provide a forwarding action on the yarn that has been passed through said second guide passage;

said guide passage of said first compression nozzle being defined by an axially elongated groove having an upper open end and a bottom surface along a yarn drawing-in direction so that a distal end portion of said yarn is drawn toward said bottom surface through said upper open end; and a plurality of second compression nozzles provided between said first drawn-through member and said plurality of second drawn-through members and respectively having blocks formed with guide passages extending therethrough.

13. A yarn drawing-in nozzle as set forth in claim 12, wherein said block of said first compression nozzle comprises a block of one piece.

14. A yarn drawing-in nozzle according to claim 12, wherein the upper open end of the groove has a width at least as great as the width of the groove at any other level between the bottom surface and the upper open end of the groove.

15. A yarn drawing-in nozzle for drawing a yarn through an eye of a drawn-through member comprising:

a compression nozzle provided in an upstream side of said drawn-through member, said compression nozzle comprising a block having an inlet end face, an outlet end face, a guide passage extending from the inlet end face to the outlet end face and intersecting the outlet end face, a first bore opening into the guide passage for supplying compressed air to said guide passage to provide a forwarding action on said yarn in said guide passage, and a second bore opening to said outlet end face of said block at a position spaced from the intersection of the guide passage with the outlet end face for supplying compressed air to further provide a forwarding action on the yarn between said block and said drawn-through member, said guide passage being defined by an axially elongated groove having an upper open end and a bottom surface along a yarn drawing-in direction so that an end portion of said yarn is drawn toward said bottom surface through the upper open end.

16. A yarn drawing-in nozzle according to claim 15, wherein the upper open end of the groove has a width at least as great as the width of the groove at any other level between the bottom surface and the upper open end of the groove.

17. Apparatus for drawing a yarn through an eye of a drawn-through member, comprising:

a compression nozzle provided in an upstream side of said drawn-through member and having a block, the block having an inlet end face and an outlet end face and being formed with a guide passage extending therethrough, the block being further formed with a first bore open into said guide passage for supplying compressed air to said guide passage to provide a forwarding action on said yarn in said guide passage, and a second bore open to said outlet end face of said block at a lower position than said guide passage for supplying compressed air to further provide a forwarding action on the yarn between said block and said drawn-through member, said guide passage of said compression nozzle being defined by an axially elongated groove having an upper open end and a bottom surface along a yarn drawing-in direction so that a distal end portion of said yarn is drawn toward said bottom surface through said upper open end; and means for inserting a yarn which extends in a direction transverse to the axis of said elongated groove by directing a flow of fluid coaxial with the axis of said elongated groove, from a point spaced from an axial end of said elongated groove, past said inlet end face and along said axis of said elongated groove, said yarn inserting means comprising a yarn insertion nozzle.

18. A yarn drawing-in nozzle for drawing a yarn through an eye of a drawn-through member, comprising:

first means for injecting compressed air along a yarn-drawing direction, said first means comprising an insertion nozzle provided on an upstream side of said drawn-through member; and a compression nozzle provided between said insertion nozzle and said drawn-through member and having a block, the block being formed with a guide passage into which an end of said yarn is inserted and through which said yarn is drawn with the aid of the compressed air injected along said yarn-drawing direction, said first means comprising means for injecting compressed air along a yarn-drawing direction into said guide passage, the block being further formed with an injection nozzle open into said guide passage at a predetermined angle with respect to said yarn-drawing direction, said injection nozzle comprising second means for injecting compressed air to said guide passage at said predetermined angle to provide a forwarding action on said yarn in said guide passage.

* * * * *